US007571812B2

(12) United States Patent
Francis

(10) Patent No.: US 7,571,812 B2
(45) Date of Patent: Aug. 11, 2009

(54) FRESHEN UP TRAVEL PACK

(75) Inventor: Ilon Francis, Bronx, NY (US)

(73) Assignee: Ilon S. Francis, Bronx, NY (US)

( * ) Notice: Subject to any disclaimer, the term of this patent is extended or adjusted under 35 U.S.C. 154(b) by 0 days.

(21) Appl. No.: 11/710,011

(22) Filed: Feb. 23, 2007

(65) Prior Publication Data

US 2007/0251840 A1 Nov. 1, 2007

Related U.S. Application Data

(60) Provisional application No. 60/794,931, filed on Apr. 26, 2006.

(51) Int. Cl.
*B65D 69/00* (2006.01)

(52) U.S. Cl. ..... 206/581; 206/494; 206/812

(58) Field of Classification Search ..... 206/205, 206/223, 581, 494, 823, 438, 812; 132/286, 132/294, 314

See application file for complete search history.

(56) References Cited

U.S. PATENT DOCUMENTS

| | | | | | |
|---|---|---|---|---|---|
| 3,889,804 | A * | 6/1975 | Ravich | ..... | 206/581 |
| 5,456,361 | A * | 10/1995 | Walsh et al. | ..... | 206/581 |
| 5,464,096 | A * | 11/1995 | Hurwitz | ..... | 206/494 |
| 5,616,337 | A * | 4/1997 | Kasianovitz et al. | ..... | 206/494 |
| 5,857,564 | A * | 1/1999 | Hymowitz | ..... | 206/812 |
| 2006/0151351 | A1 * | 7/2006 | Hughes | ..... | 206/494 |

* cited by examiner

*Primary Examiner*—Luan K Bui
(74) *Attorney, Agent, or Firm*—Albert Jacobs LLP; Albert L. Jacobs, Jr.

(57) ABSTRACT

The present invention relates to a travel pack containing a deodorant and a moistened cleansing cloth wrapped separately in a small waterproof foil package. The travel pack comprises a first side containing a deodorant contained in a suitable applicator and a second side containing a moistened cleansing cloth, and a separator preventing the contents of the first side from coming in contact with the contents of the second side. The travel pack is small enough to be conveniently carried in a pocket and can be used anytime a person needs to freshen up.

3 Claims, 2 Drawing Sheets

FRESHEN UP TRAVEL PACK

CROSS-REFERENCE TO RELATED APPLICATION

This application claims the benefit of Provisional Application No. 60/794,931, filed Apr. 26, 2006.

BACKGROUND OF THE INVENTION

The present invention relates to a travel pack containing a deodorant and a moistened cleansing cloth wrapped separately in a small waterproof foil package.

This product can be used when a person needs to freshen up but a shower is not an option. The person can use the cloth to clean the underarm area and then apply the deodorant. Currently there is no convenient deodorant travel pack available in the market. Traditionally one has to bring along a travel size deodorant and a separate package of moistened wipes or wash cloth and water to clean the underarm area prior to applying the deodorant. A unit dose personal travel pack comprising a deodorant and a moistened cleansing cloth is therefore more convenient and preferable.

DESCRIPTION OF THE INVENTION

The present invention relates to a personal cleansing product comprising a deodorant contained in a suitable applicator and a moistened cleansing cloth, each separately wrapped in a waterproof foil package. The deodorant is contained in a suitable applicator, such as cardboard. The applicator is folded preferably in the shape of a semi-cylinder, similar to the shape of Hot Pockets™ microwave pack.

Referring first to FIG. 1, it shows a top view of the package (1). The package is preferably made of waterproof foil, such as plastic-lined aluminum foil. A first side (2) of the package contains a deodorant in a cardboard application. A second side (3) of the package (1) contains a moistened cleaning cloth. Each side (2, 3) of the package (1) preferably contains a notch (4, 5) for easy opening. Also, in a preferred embodiment, the first side (2) and the second side (3) are separated from each other by a separator (6). The separator (6) can be a seam or crimp in the package (1). Preferably, the separator (6) prevents the contents of the first side (2) from coming in contact with the second side (3).

Referring to FIG. 2, it shows a side view of an applicator (7), preferably made of cardboard, which contains a deodorant. This applicator (7) is contained in the first side (2) of the package (1) as shown in FIG. 1.

The deodorant is preferably free of synthetic chemicals and may comprise of the following natural substances: chamomile, shea butter, witch hazel, corn starch, and beeswax. The cloth is moistened with a gentle cleanser so that it will not irritate the skin. This product can be used when a person needs to freshen up but a shower is not readily available or where there is no water source to be found. The person can use the moistened cloth to clean the underarm area and then apply the deodorant. To apply the deodorant, one can unfold the cardboard applicator and slide out the deodorant over their index finger and apply it to the underarm.

One preferred formulation for the deodorant is as follows: 1 chamomile tea bag, 2 cups water, 2.5 oz. shea butter, 1.5 cups corn starch, 4 oz. witch hazel, 4 oz. baking soda and 1 oz. beeswax. The deodorant is prepared according to the following steps: (1) dissolve corn starch in cool water, (2) once dissolved, bring it to a boil while stirring it constantly, (3) place tea bag in mixture and boil for two minutes, (4) remove tea bag and reduce to low heat, (5) add witch hazel and baking soda, (6) add melted shea butter and beeswax, stir over low heat until mixture thickens—mixture must be stirred continuously to prevent clumping, (7) when the mixture is smooth place in applicators and let cool.

The travel pack is small enough to be conveniently carried in a pocket. The waterproof foil protects the deodorant and the cleansing cloth from drying out. The foil has a notch on each side of the package for ease of opening.

Figure 1:
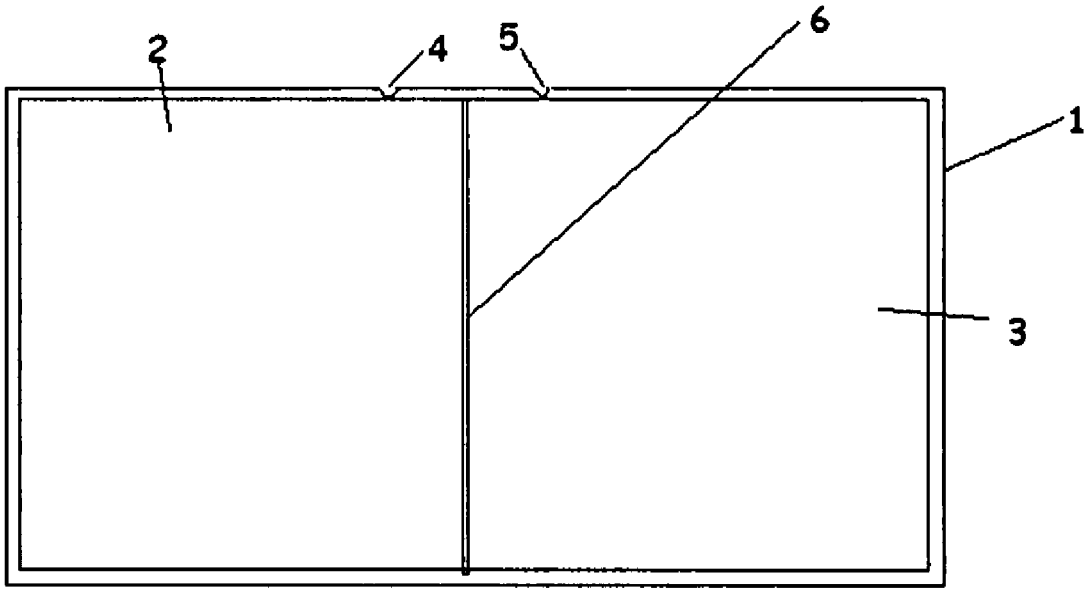
FIG. 1 is a top view of the separately sealed foil package with one side containing the deodorant in a cardboard applicator and another side containing a moistened cleansing cloth. Each side has a notch for easy opening of the foil.
Figure 2:
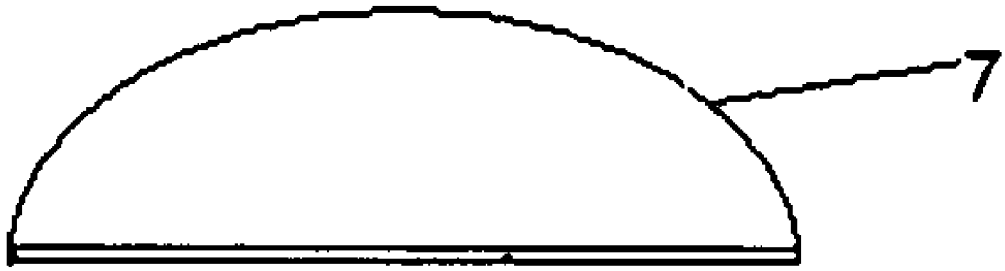
FIG. 2 is a side view of the deodorant contained in a cardboard applicator which is folded in the shape of a semi-cylinder and sealed at the bottom.

What is claimed is:

1. A travel pack comprising a deodorant which is free of synthetic chemicals and comprises a mixture of chamomile, shea butter, witch hazel, corn starch and beeswax and a moistened cleaning cloth packaged such that the deodorant and the moistened cleaning cloth are maintained separate from one another in a waterproof package, wherein one side of the waterproof package contains the deodorant for application to a human and the other side of the waterproof package contains the moistened cleansing cloth, said one side and said other side being separated from each other to avoid contact between the deodorant and the moistened cleaning cloth.

2. A pack according to claim 1 made of waterproof aluminum foil.

3. A claim according to claim 1 wherein the deodorant is contained in a semi-cylindrical container.

* * * * *